United States Patent [19]

Tsui et al.

[11] 4,338,741

[45] Jul. 13, 1982

[54] TOY DRYER

[75] Inventors: Kwok W. Tsui; Sing C. J. Yuen, both of Hong Kong, Hong Kong

[73] Assignee: Arco Industries Ltd., Hong Kong, Hong Kong

[21] Appl. No.: 252,311

[22] Filed: Apr. 9, 1981

[51] Int. Cl.[3] ..... A63H 3/52

[52] U.S. Cl. ..... 46/14

[58] Field of Search ..... 46/14, 39, 47

[56] References Cited

U.S. PATENT DOCUMENTS

| | | | |
|---|---|---|---|
| 2,615,280 | 10/1952 | Thelin | 46/14 |
| 2,831,293 | 4/1958 | Götz | 46/14 |
| 3,187,459 | 6/1965 | Glass et al. | 46/14 |
| 3,774,338 | 11/1973 | Waak | 46/14 |

*Primary Examiner*—Robert Peshock
*Assistant Examiner*—Mickey Yu
*Attorney, Agent, or Firm*—C. Hercus Just

[57] ABSTRACT

A toy dryer having a box-like cabinet with a front wall provided with an opening for insertion and removal of items, a hinged door for the opening, a cup-shaped drum having an open end facing the opening and supported by a horizontal drive shaft in the cabinet, a slide having rack teeth along one edge for engagement with a throw-out gear of a gear train operated by reciprocation of the slide in feed direction and the throw-out gear permitting return of the slide without interference with unidirectional drive of the drum, and an extension on the slide extending through a slot in the top of the cabinet terminating in a finger-engageable operating knob by which the slide is reciprocated in driving direction and a spring effects return movement when the knob is released. The cabinet also includes interior-planar frame members which support the slide and gear train and projections and pedestal members support the frame members and effect connection of various walls of the cabinet together.

7 Claims, 5 Drawing Figures

TOY DRYER

BACKGROUND OF THE INVENTION

The present invention is directed to a toy dryer having a spinning or rotating drum mounted for rotation about a horizontal axis within a cabinet, generally similar to the well-known Bendix washer and dryer. At present, no prior patents are known to exist on toy dryers of this type, but from a structural standpoint, the following U.S. Patents disclose rotatable drums in toy washing machines:

U.S. Pat. No. 2,615,280, Thelin, Oct. 28, 1952

U.S. Pat. No. 3,187,459, Glass et al, June 8, 1965

The foregoing patents show toy washing machines having drums which are rotatable about a horizontal axis and are driven by electric motor means, but the general construction, particularly the gear means of the drive comprising the present invention, is completely different from the foregoing prior art.

SUMMARY OF THE INVENTION

It is among the principal objects of the present invention to provide a toy dryer having a box-like cabinet in which the front wall is provided with an opening and a cup-shaped drum open at one end is supported within said cabinet for unidirectional rotation about a horizontal axis and the open end of the drum is adjacent said opening, rotation of the drum being effected by manually-operable means including an actuating member movable within the cabinet in successive driving and return directions, and having a projection extending through a slot in the top of the cabinet upon which an operating knob is mounted for manual engagement, and a gear train within the cabinet is interconnected axially with the drum and is engaged by said actuating member for operation thereof to rotate the drum when said actuating member is moved in a driving direction but including means operable to permit movement of the actuating member in return direction without interfering with the unidirectional rotation of the drum.

It is another object of the invention to provide the actuating member in the form of a slide arranged in guide means within the cabinet which support the slide for reciprocatory movement in opposite directions and spring means being provided to effect return movement of said slide following each movement thereof in driving direction.

A further object of the invention is to provide in the cabinet of said toy dryer, a pair of transversely-spaced vertical interior, preferably planar, frame members rearwardly of the drum and respectively having coaxial horizontal bearings which support a drive shaft for the drum, and a driven gear of said gear train is fixed to said shaft for operation thereof.

Still another object of the invention is to include in said gear train a throw-out gear and the slide having a row of rack teeth thereon engageable with a spur gear coaxially fixed to the throw-out gear and operable to engage said throw-out gear with another gear of said gear train when the slide is moved in driving direction but disengage said throw-out gear from said another gear when the slide is moved in return direction.

A still further object of the invention is to utilize interengaging horizontal projecting members disposed upon and connected to the interior planar frame members and/or the front and back panels of the cabinet for purposes of supporting said interior frame members within the cabinet and also connecting the front and back panels of the cabinet together.

Details of the foregoing objects and of the invention are set forth in the following specification and illustrated in the accompanying drawings comprising a part thereof.

DETAILED DESCRIPTION OF THE PREFERRED EMBODIMENT

Figure 1:
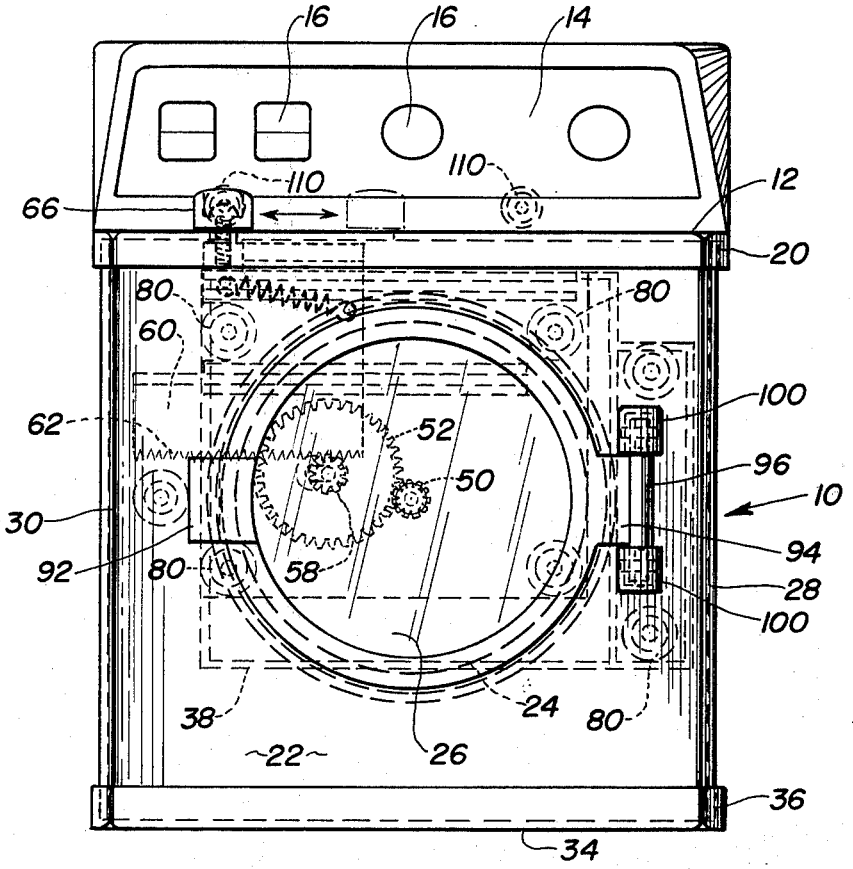
FIG. 1 is a vertical front elevation of the toy dryer embodying the principles of the present invention.

Referring particularly to FIGS. 1–4, it will be seen that the toy dryer comprising the present invention includes a cabinet 10, comprising a top 12 which is substantially horizontal and the rearward portion thereof has an upwardly and rearwardly sloping panel 14, which includes imitation dials 16 and the like, such as a timer and clock, for example. The upper edge of the panel 14 extends rearwardly and overlies the upper edge of a planar back wall member 18. Also, the forward edge of top 12 has a downwardly extending flange 20, which overlies the upper edge of vertical front wall 22, which is provided with a central circular opening 24 adapted to be closed by a hinged cover 26.

Figure 4:
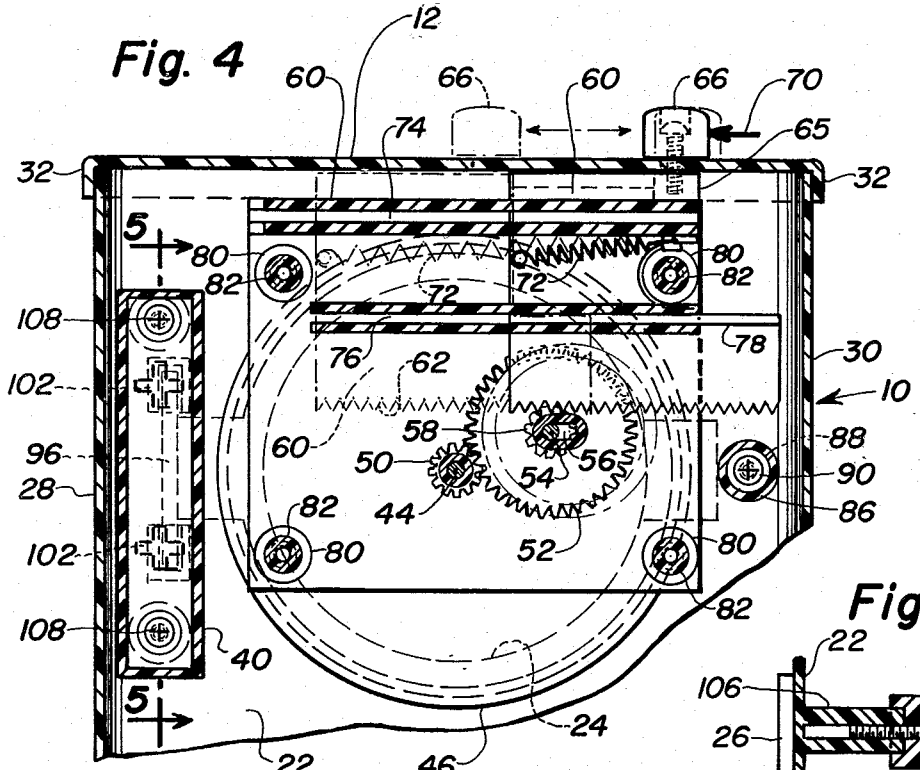
FIG. 4 is a fragmentary vertical sectional view, primarily of the upper portion of the toy dryer shown in FIG. 3, as seen on the line 4—4 thereof.

The front wall 22 preferably is integral with a pair of sidewalls 28 and 30, which are best shown in FIG. 4 and the opposite edges of top 12 also have depending flanges 32, which overlie the upper edges of the sidewalls 28 and 30, as also shown in FIG. 4. The cabinet 10 also includes a bottom 34, all edges of which have a short upstanding wall 36 thereon, which surrounds the lower edges of the back, front and sidewalls 18, 22, 28 and 30, and together with the downward extending flanges 20, 32 around the edges of top 12, greatly facilitate the assembly of the cabinet and impart strength thereto.

Figure 2:
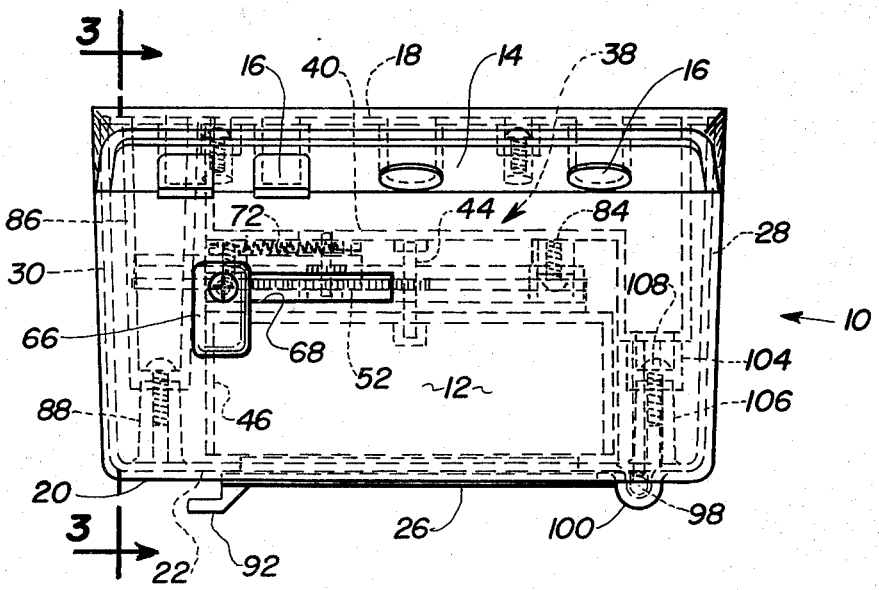
FIG. 2 is a top plan view of the toy dryer shown in FIG. 1.

Attached to the back wall 18 is a box-like rectangular frame member 38, which is best shown in vertical outline in phantom in FIG. 1, and also in plan view in phantom in FIG. 2. The innermost wall thereof which is parallel to the back wall 18 comprises a vertical interior frame member 40, and the same is transversely spaced from another parallel vertical interior frame member 42, said frame members constituting so-called frame plates between which a gear train is mounted, as explained in detail hereinbelow. Said plates respectively have pairs of horizontally aligned bearings, one pair of which supports a driven shaft 44, one end of which projects through the frame member 42 and is secured to the vertically disposed bottom of a cup-shaped drum 46 provided with an open face 48, which is coaxial with the central opening 24 in front wall 22. Fixed to the shaft 44 is a spur gear 50 comprising part of the aforementioned gear train which is adapted to be meshed with a larger diameter throw-out gear 52 supported on shaft 54, the opposite ends of which are supported in short horizontal slots 56, best shown in FIG. 4, and respectively formed in the frame members 40 and 42. Another spur gear 58 comprising a driving gear is fixed to throw-out gear 52 and is coaxial therewith on shaft 54.

Figure 3:
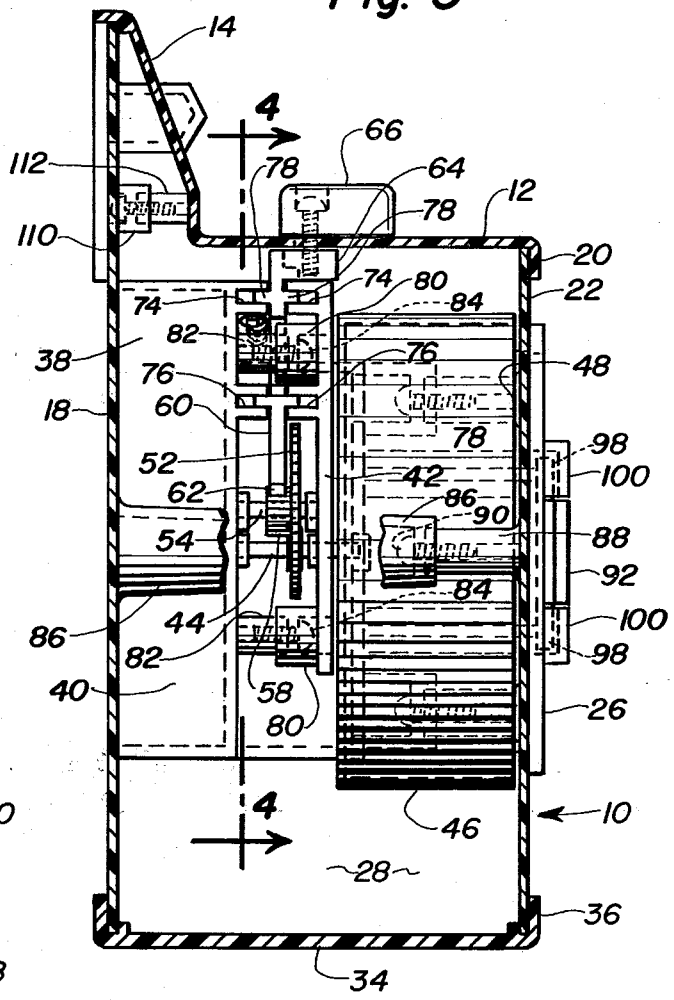
FIG. 3 is a vertical sectional view of the toy dryer shown in FIG. 2, as seen on the line 3—3 thereof.

The gear train comprising the spur gears 50 and 54 and also throw-out gear 52 is actuated by a vertical slide 60, which is plate-like and the lower edge thereof is horizontal and has a row of teeth comprising a rack 62, best shown in FIGS. 1 and 4, but also, in edge view, in FIG. 3. Rack 62 meshes with spur gear 58 to drive the same when the slide is moved in driving direction, which is toward the left, as viewed in FIG. 4. Slide 60 has an upstanding projection 64 immediately below the inner surface of top 12, as shown in FIG. 3, and a finger-engaging knob 66 has a portion extending through a slot 68 in top 12, best shown in FIG. 2, and of sufficient length to enable the actuating member comprising slide 60 to reciprocate for a substantial distance from the starting position, shown in full lines in FIG. 4, to the phantom position thereof also shown in said figure, the driving direction being indicated by the heavy arrow 70 in FIG. 4.

The driving movement of the actuating slide member 60 causes the rack 62 to engage spur gear 58 and rotate the same counterclockwise, as viewed in FIG. 4, thereby driving the spur gear 50 clockwise and causing similar clockwise rotation of the drum 46. When the knob 66 reaches the full extent of its driving movement, as shown in phantom in FIG. 4, it then is released quickly and tension spring 72, see FIG. 4, which is extended during such driving movement, contracts to restore the slide 60 to the starting position shown in full lines in FIG. 4. During such return movement, the first part of such movement causes rack 62 to engage spur gear 58 and rotate the same clockwise, thereby immediately disengaging the throw-out gear 52 from the driven spur gear 50, and thereby, not interfere with the continued counterclockwise rotation of the drum 46 established by the slide 60 when moving in driving direction.

For purposes of suitably guiding and supporting the slide 60, it will be seen especially from FIGS. 3 and 4 that the vertical frame members 40 and 42 each have pairs of ribs respectively facing each other and defining therebetween facing guide channels 74 and 76, which respectively receive elongated ribs 78, respectively formed on opposite surfaces of slide 60. Accordingly, ample and accurate guiding of the slide 60 is assured for engagement of the rack 62 with the spur gear 58 to rotate the same in both driving and retreating or retracting direction to control the movement of the throw-out gear 52, as described above.

For purposes of securing the interior frame member 42 to its companion interior member 40, the inner surface of member 42 is provided with a plurality of cup-like projections 80, which engage and are coaxial with similar aligned projections 82 on frame member 40 and the respective pairs of projections are firmly secured together by screws 84, shown in phantom in FIG. 3.

Figure 5:
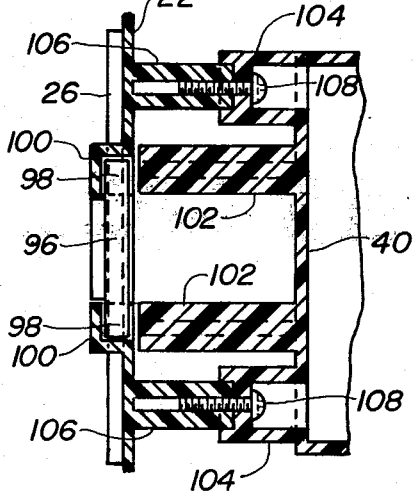
FIG. 5 is a fragmentary vertical sectional view of a portion of the toy dryer shown in FIG. 4, as seen on the line 5—5 thereof, which primarily is associated with the hinge detail structure for the cover for the front opening of the cabinet.

For purposes of securing front wall 22 and the integral sidewalls 28 and 30 thereon with back wall member 18, it will be seen from FIG. 3 that back wall member 18 has a relatively long projection 86 extending inwardly therefrom into engagement with a shorter projection 88 on front wall 22, the inner ends thereof having coaxial interfitting means to receive a securing screw 90. From FIG. 4, it will be seen that the projections 86 and 88 are adjacent the right-hand side of the cabinet 10, as shown in FIG. 4, while additional means secure the left-hand portions of back wall 18 and front wall 22 together, the latter also having additional functions described as follows:

Hinged cover 26 is circular as shown in FIG. 1, and at one edge has a projection 92 for manual engagement to open and close the cover. The opposite edge of the cover has another projection 94, which extends laterally and terminates in a vertical member 96, see FIGS. 1 and 5, having oppositely extending projecting ends 98, which serve as pintles. Front wall 22 also is formed with a pair of semi-circular projections 100, which have inner opening sockets that respectively receive the projecting ends 98 of vertical member 96 and effect hinge means for the cover 26.

In order to maintain the projecting ends 98 within the semi-circular projections 100, the vertical interior frame member 40 is provided with a pair of cruciform projections 102, which project from frame member 40 toward the inner surface of wall 22 and terminate immediately adjacent the same so as to be in a position to prevent removal of the projecting ends 98 of the hinge means from the sockets therefor in the semi-circular projections 100. In addition, the same face of the frame member 40 is provided with a pair of shorter projections 104, which are coaxial with and also are aligned with projections 106 extending inward from the vertical front wall 22, the aligned pairs of projections being secured by self-tapping screws 108.

In order that the manufacture of the toy dryer comprising the present invention may be minimized in cost, it is preferred that, as far as possible, all components thereof, with the exception of the elements of the gear train, be formed by molding from plastic material and it will be seen from the foregoing that in view of the interfitting relationship between the various panels comprising the cabinet, etc., that assembly is facilitated by the interfitting relationship of the various panels. Referring to FIG. 3, it also will be seen that the rear portion of the top 12 and the upper portion of the back wall 18 are provided with interfitting projections 110 and 112 and are secured together by screws clearly shown in FIG. 3. Accordingly, minimum manual operations are required in effecting the assembly of the entire structure.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A toy dryer comprising in combination, a generally rectangular cabinet having a top, bottom, sides, back and also a vertical front wall provided with an opening, all of which are molded from plastic material and connected to form said cabinet, a cup-shaped drum open at one end and supported within the cabinet for unidirectional rotation about a horizontal axis with the open end immediately adjacent said opening and occupying the forward portion of said cabinet, an actuating slide movable within a vertical plane in said cabinet in successive driving and return directions and having a toothed rack along one edge and a projection extending through a slot in said top of the cabinet terminating in a knob, a pair of transversely spaced vertical interior frame members in said cabinet rearwardly of said drum therein and respectively having coaxial horizontal bearings and spaced parallel pairs of facing guide grooves, a drive shaft for said drum supported by said bearings and fixed at one end to said drum, a gear train in said cabinet supported upon shafts mounted in bearings in said frame members and including a driven gear fixed to said drive shaft and engaged by said rack for operation of said gear train to actuate said driven gear to rotate said drum when said rack member is moved in said driving direction, means operable to permit movement of said actuating slide in return direction without interfering with the unidirectional rotation of said drum, and means on one of said frame members connected to the back of said cabinet for support of said gear train and slide.

2. The toy dryer according to claim 1 in which said gear train includes a throwout gear and the rack on said slide being interengageable with said throwout gear and operable to engage said throwout gear with another gear of said gear train when said slide is moved in driving direction but disengage said throwout gear from said another gear of said train when said slide is moved in return direction.

3. The toy dryer according to claim 1 in which one of said interior frame members is substantially planar and adjacent the innermost portion of said drum and the other of said interior frame members being between said back and said one of said interior frame members, and means fixed to said back and connected to said other of said interior frame members to support the same.

4. The toy dryer according to claim 3 in which said interior planar frame members have post-like means extending toward each other and connected together for support of said one interior frame member.

5. The toy dryer according to claim 4 further including a pedestal member extending forwardly from said back wall member and interengaging the front wall of said cabinet to secure the same in operative position.

6. The toy dryer according to claim 3 further characterized by said cabinet having parallel sidewalls respectively connected at the forward edges to the opposite side edges of said front wall of said cabinet to form a U-shaped cabinet member, said cabinet further including a bottom panel having short upstanding flanges along at least some of the edges thereof for positioning the bottom edges of said U-shaped cabinet members and back wall member closely along the inner surfaces thereof, and said top of said cabinet also having short downward extending flanges along at least some of the edges thereof to extend downwardly over the corresponding upper edges of said U-shaped cabinet member to further position the aforementioned members of said cabinet in desired enclosing condition.

7. The toy dryer according to claim 3 in which said front wall has a cover for said opening hingedly connected thereto by one edge of said cover having a pair of oppositely extending vertical pintles thereon and said front wall having sockets complementary to and receiving said pintles from the inner surface of said front wall, and the interior frame member nearest said front wall having projections extending forwardly into juxta-position with said pintles to maintain the same in said sockets.

* * * * *